US006634400B2

(12) United States Patent
Barbosa

(10) Patent No.: US 6,634,400 B2
(45) Date of Patent: Oct. 21, 2003

(54) LABELING MACHINE

(75) Inventor: Valdemar Barbosa, Fresnes (FR)

(73) Assignee: NS Testut SAS, Bethune (FR)

( * ) Notice: Subject to any disclaimer, the term of this patent is extended or adjusted under 35 U.S.C. 154(b) by 0 days.

(21) Appl. No.: 10/156,832

(22) Filed: May 30, 2002

(65) Prior Publication Data

US 2002/0185231 A1 Dec. 12, 2002

(30) Foreign Application Priority Data

May 30, 2001 (FR) ..... 01 07046

(51) Int. Cl.[7] ..... B65C 9/00; B65C 9/08; B65C 9/18

(52) U.S. Cl. ..... 156/384; 156/350; 156/542; 156/DIG. 28; 156/DIG. 33

(58) Field of Search ..... 156/350, 384, 156/540, 541, 542, 556, 566, DIG. 24, DIG. 28, DIG. 33, DIG. 37, DIG. 45

(56) References Cited

U.S. PATENT DOCUMENTS 3,428,509 A * 2/1969 Messmer ..... 156/361
3,616,094 A * 10/1971 Navin et al. ..... 156/571
4,124,436 A 11/1978 Pettis, Jr. et al.
4,390,390 A * 6/1983 Margraf et al. ..... 156/566
4,595,447 A 6/1986 Lindstrom
4,857,121 A * 8/1989 Markley et al. ..... 156/64
4,895,614 A * 1/1990 Trouteaud et al. ..... 156/542
6,009,926 A 1/2000 Vicktorius et al.
6,080,250 A 6/2000 Urban et al.

FOREIGN PATENT DOCUMENTS

DE 41 35 106 A1 4/1993

* cited by examiner

*Primary Examiner*—Richard Crispino
*Assistant Examiner*—Sue A. Purvis
(74) *Attorney, Agent, or Firm*—Young & Thompson

(57) ABSTRACT

The invention provides a labeling machine comprising a structure, a labeling head capable of pivoting relative to the structure about a pivot axis, the labeling head being fitted with gripper means for gripping a label holding it in a plane that is substantially normal to the pivot axis of the labeling head, and placing means carried by the labeling head and adapted to take the label held by the gripper means and place it on an article to be labeled that is present on the labeling machine. According to the invention, the gripper means hold a label in such a manner that a corner thereof coincides substantially with the point of intersection of the pivot axis and the plane of the label.

10 Claims, 5 Drawing Sheets

LABELING MACHINE

The invention relates to a labeling machine.

BACKGROUND OF THE INVENTION

As a general rule, a conventional labeling machine comprises a conveyor for transporting articles to be labeled and a labeling head mounted on a bracket extending over the conveyor and fitted with label-gripper means that hold the label in a plane parallel to the face of an article in register with the labeling head. Applicator means secured to the labeling head are adapted to move the label held by the gripper means onto the article that is to be labeled. The labeling head moves on the bracket in a direction perpendicular to the travel direction of the conveyor.

In order to adjust the position of the label on the article, the movement of the labeling machine head on the bracket is controlled as is the advance of the conveyor in such a manner as to cause a reference point on the labeling machine head to coincide with a reference point on the article, in general the corner of a label-receiving zone on the article.

The labeling machine is sometimes required to be capable of positioning the label on the article in any specified orientation. In order to be able to do this, the labeling head of such a labeling machine can turn about a pivot axis.

However, if no special precautions are taken, then turning of the labeling head gives rise not only to a change in the orientation of the label relative to the article, but also to an offset in the position of the label relative to the position expected for it on the article. This offset is either the result of the reference point of the labeling head not coinciding with the pivot axis of the labeling head, or else the result of the label being offset relative to the pivot axis.

In order to remedy that offset, it is appropriate to correct the position of the article relative to the labeling head in the travel direction of the conveyor by moving the conveyor forwards or backwards, and in a direction that is perpendicular thereto by moving the labeling head on the bracket so as to reposition the pivoted label relative to the article. These correcting displacements make it awkward to position a label relative to an article. Furthermore, these displacements vary with varying angle of rotation for the labeling head, further complicating control of pivoting of the labeling head.

OBJECTS AND SUMMARY OF THE INVENTION

According to the invention, the gripper means is arranged on the labeling head in such a manner that when it holds a label, a corner of the label coincides substantially with the point of intersection of the pivot axis with the plane of the label.

Thus, in order to position the label correctly on an article, the conveyor is caused to advance and the labeling head is moved so that the pivot axis intersects both the corner of the label and the reference point on the article. The label then pivots with the labeling head so that its corner continues to coincide with the reference point on the article, regardless of the angle through which the labeling head is pivoted. There is no longer any offset induced by the pivoting of the labeling head.

Advantageously, the labeling head has a printer with active print means and with means for driving the label through the printer, the gripper means being situated immediately downstream from the active print means.

Placing the active print means on board the labeling head, avoids incessant go-and-return trips of the labeling head between external print means and a labeling position overlying the conveyor of the labeling machine.

Advantageously, the active print means are controlled by control means that are not secured to the labeling head. The portions of the printer that are not active from the point of view of printing are thus located on the labeling machine, thereby simplifying the design of the labeling head.

Preferably, the active print means are adapted to receive a strip supporting adhesive labels coming from a roll, the labeling head having deflector members for imparting a twisted trajectory to the strip between the roll and the active print means.

By "twisted", it should be understood that the midplane of the strip does not remain constant as the strip travels between the roll and the active print means. The roll is thus offset from the active print means, thus making it possible to design a labeling head that presents a smaller moment of inertia, and that is of more compact structure.

In a first embodiment, the roll is placed on the labeling head beside the active print means. The roll is thus placed close to the axis of rotation of the labeling head, thereby reducing its moment of inertia.

In a second embodiment, the roll is mounted to rotate on the structure of the labeling machine, with the deflector members comprising a deflector cylinder secured to the labeling head and extending parallel to the pivot axis of the labeling head. In this way, the labeling head is lightened by a weight corresponding to the weight of the roll, and because of the deflection parallel to its pivot axis, the labeling head can still be oriented at any angle while nevertheless ensuring that the support strip is fed properly.

Advantageously, separation means for separating the support strip from the label are located between the active print means and the gripper means, such separation means being associated with means for re-winding the support strip.

Preferably, the gripper means comprise a suction member holding the label via a non-adhesive face thereof.

The gripper means is then associated with placing means comprising a pusher movable in a direction parallel to the pivot axis of the labeling head and pushing the label by means of its non-adhesive face towards the article that is to be labeled.

In order to position the label relative to the article that is to be labeled, the structure includes a bracket forming a support for the labeling head, the labeling head being movable along the bracket in a direction perpendicular to its pivot axis and perpendicular to a travel direction of the article to be labeled.

BRIEF DESCRIPTION OF THE DRAWINGS

Other characteristics and advantages of the invention appear more clearly in the light of the following description of particular, non-limiting embodiments of the invention. Reference is made to the accompanying figures, in which.

MORE DETAILED DESCRIPTION

Figure 1:
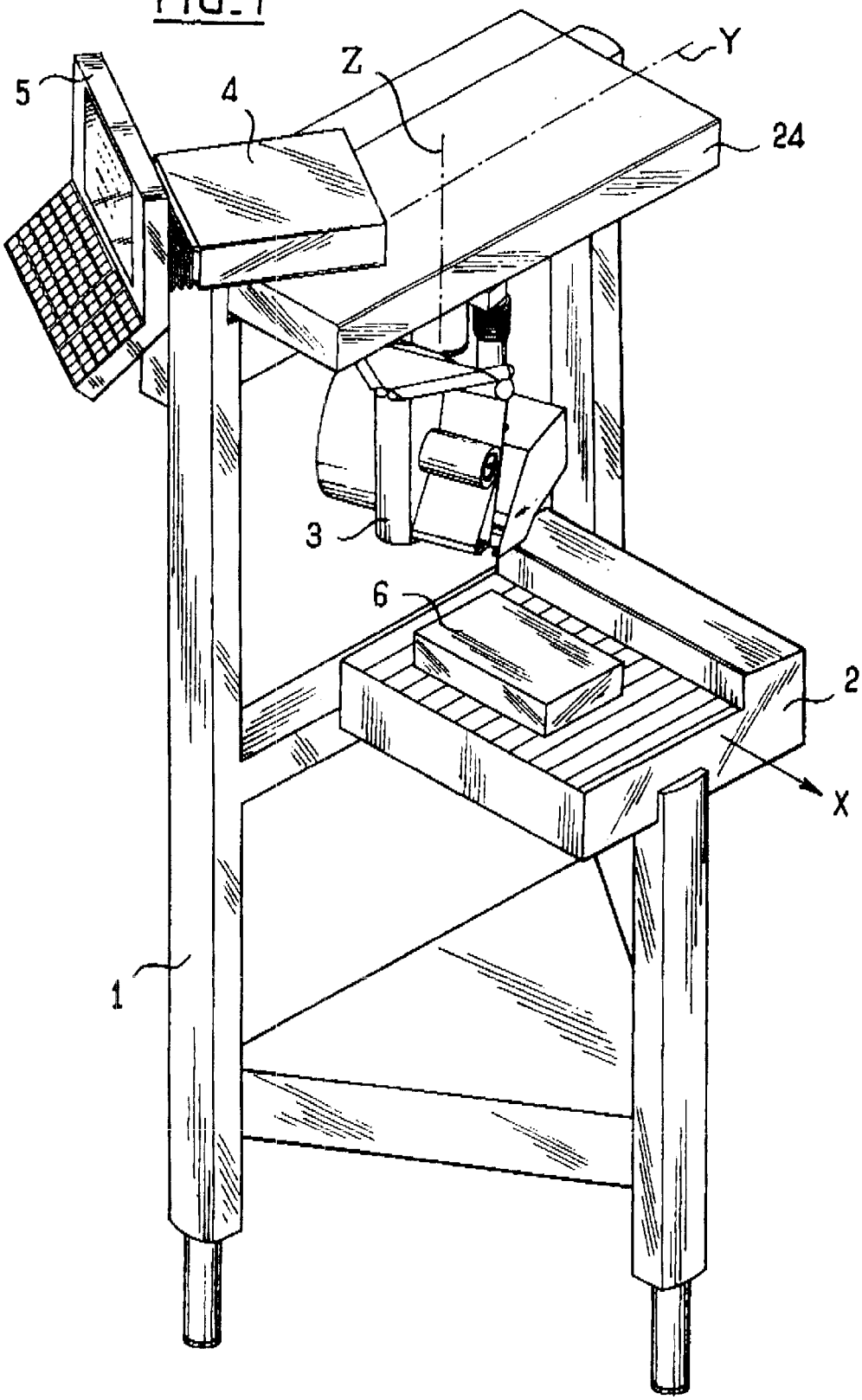
FIG. 1 is a perspective view of a labeling machine of the invention.

With reference to FIG. 1, a labeling machine comprises a structure 1 carrying a conveyor 2, in this case of the roller type, together with a labeling head 3 which is described below with reference to FIG. 2.

The labeling head 3 is mounted to move on a bracket or gantry 24 of the structure 1 which extends over the conveyor 2 transversely to a forward travel direction X thereof. The head is movable along the bracket 24 in a direction Y that is substantially perpendicular to the forward travel direction X of the conveyor 2. The labeling head 3 is also suitable for pivoting relative to the bracket 24 about an axis of rotation Z that is perpendicular to the direction X and Y.

Displacements along the directions X and Y enable the labeling head 3 to be put into a determined position over an article to be labeled 6, while pivoting about the axis Z enables the orientation of the labeling head 3 to be adjusted relative to the article 6.

The structure 1 also carries a unit 4 containing the control electronics for the labeling machine, together with a console 5 enabling an operator to control the labeling machine.

Figure 2:
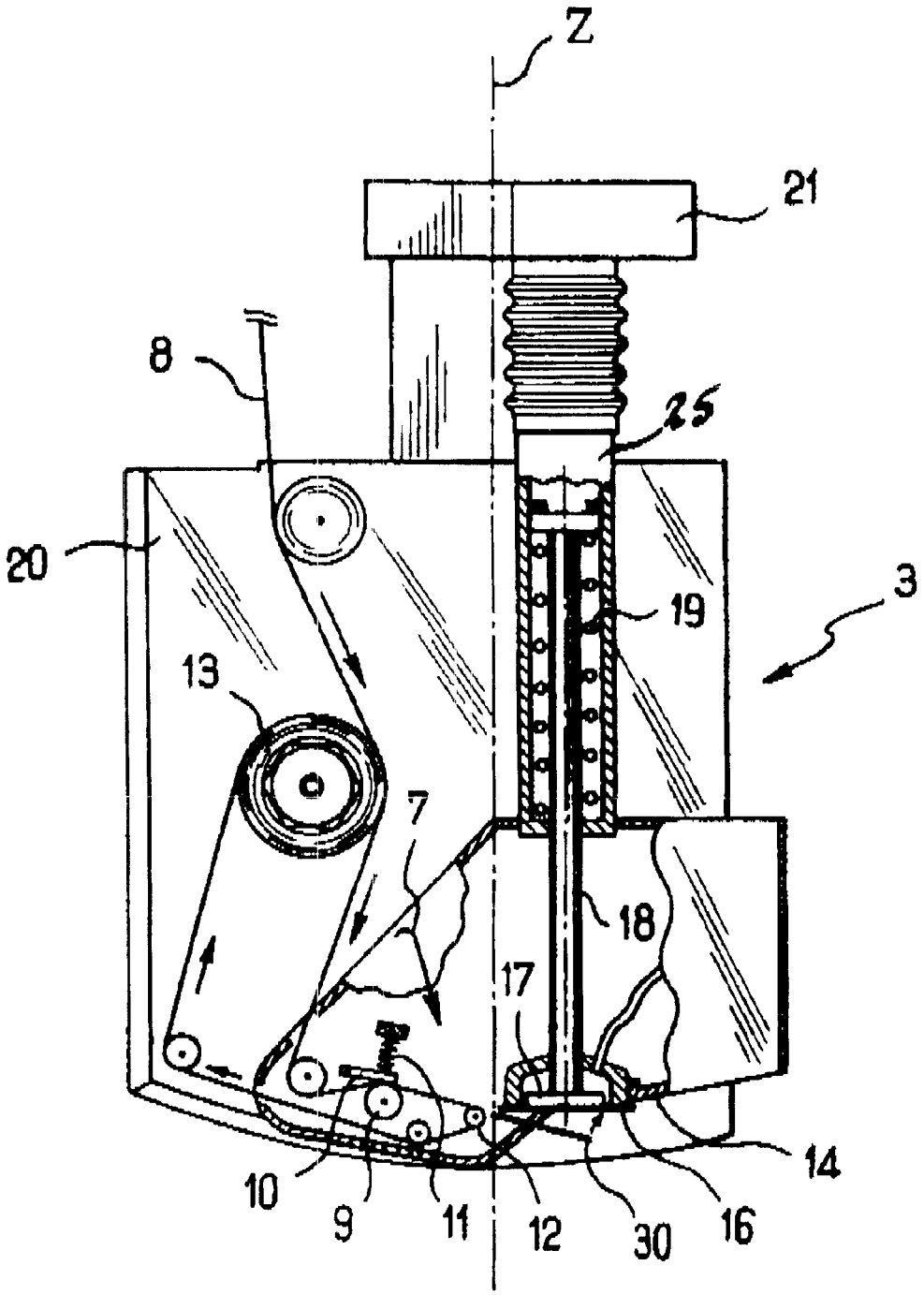
FIG. 2 is a side view in partial section showing a labeling head fitted to a labeling machine of the invention.

With reference to FIG. 2, the labeling head 3 comprises a support 20 mounted to rotate about the axis Z on a pivot 21 that is movable along the bracket 24. The support 20 carries a printer 7 for printing adhesive labels carried by a support strip 8 engaged in the printer 7, and advancing in the direction represented by arrows. In conventional manner, the printer 7 has a drive roller or "capstan" 9 and a thermal print head 10 pivotally mounted about an axis parallel to the capstan axis and urged against the capstan by resilient means 11. The support strip 8 passes between the capstan 9 and the thermal print head 10 so as to enable labels carried by the support strip 8 to be printed. The capstan also drives the support strip 8 and thus causes the labels to move past the print head 10.

In this case, the printer 7 on board the labeling head comprises only the active print means of a printer, while the means for controlling said active print means are located elsewhere in the unit 4 so as to lighten the labeling head 3 and so as to put all of the electronics of the labeling machine in a single location.

Downstream from the capstan 9, the support strip 8 passes via a separator 12, constituted in this way by a small-diameter roller causing the support strip 8 to pass round a tight curve so that the labels separate from the support strip 8. There can thus be seen a label 30 separated from the support strip 8. The support strip 8 is deflected by a set of rollers towards a take-up spool 13. In a variant, the spool 13 could be used for driving the strip and causing the labels to travel past the print head 10.

The label 30 continues to advance and it is taken up by gripper means 14 located immediately downstream from the outlet from the printer 7, overlying the label 30.

In this case, the gripper means 14 comprise a suction device having a bearing outline 16 lying in a plane that is substantially normal to the pivot axis Z of the labeling head 3. When the label 30 is in register with the bearing outline 16, suction is established between the bearing outline 16 and the label 30, thus enabling the label to be held against the bearing outline 16. The suction is established by suction means, represented merely by a single suction hose.

Thereafter, to take the label 30 and press it against the article 6, a pusher 17 having a sliding axis parallel to the pivot axis of the labeling head 3 is disposed on the labeling head so as to push the label 30 up to the article 6, the label 30 remaining pressed against the pusher 17 by the effect of aerodynamic drag acting on the label 30. The pusher 17 is connected to a piston-forming rod 18 that slides in an actuator 25. The pusher 17 is actuated in this case by admitting compressed air into the compartment 24 for pushing against the piston of the rod 18. The compressed air transmits the necessary impulse to the rod 18 to ensure that the pusher 17 reaches the article 6 for labeling. The label 30 is then stuck on the article 6 and the pusher moves back up under drive from a return spring 19.

According to the invention, the label 30 is held by the gripper means 14 so that a corner of the label 30 coincides with the intersection of the pivot axis Z of the labeling head 3 and the plane of the label 30.

Figure 3A:
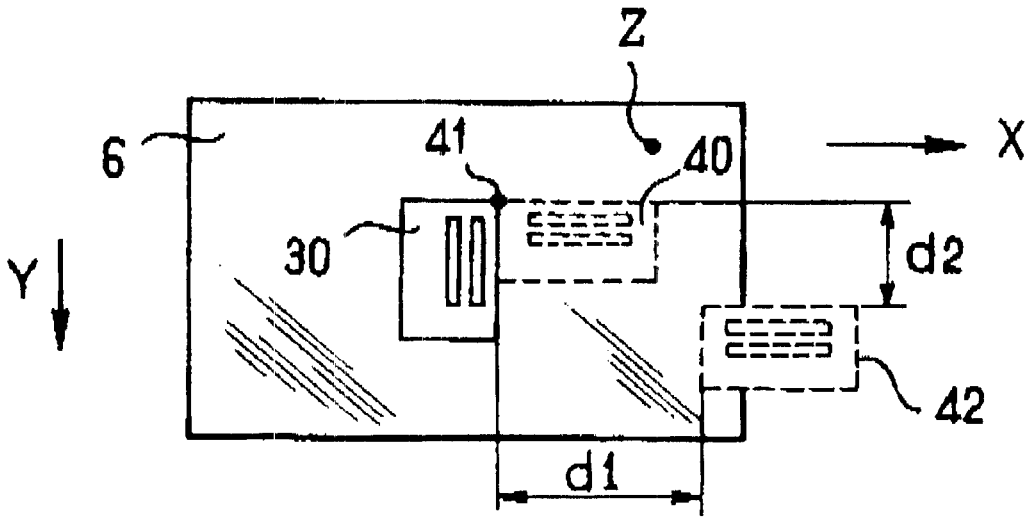
FIG. 3*a* is a diagrammatic plan view showing a portion of a prior art labeling machine.
Figure 3B:
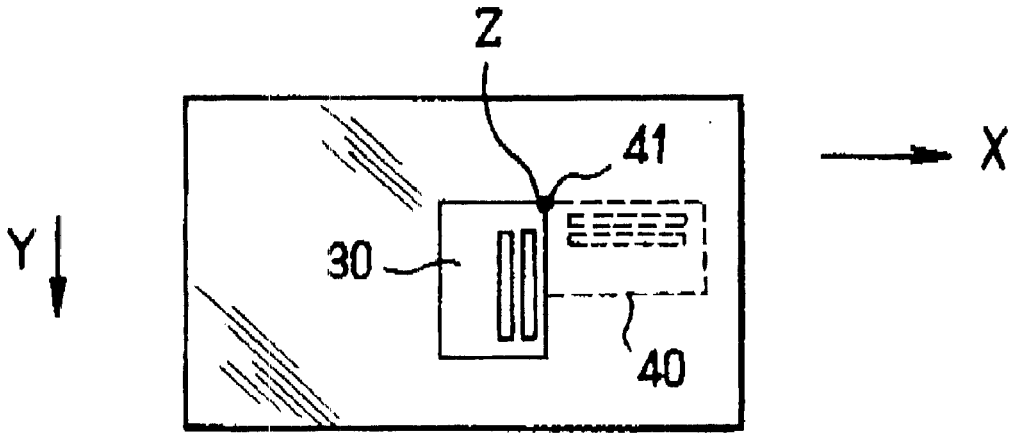
FIG. 3*b* is a diagrammatic plan view showing a portion of a labeling machine of the invention.

FIGS. 3*a* and 3*b* show the advantage of this disposition.

FIG. 3*a* relates to a labeling machine that does not have this disposition, and an article 6 present on the conveyor 2 of the machine, which article is to receive a label 30 in the position 40 shown in dashed lines.

To do this, the position of a reference point 41 on the article 6 is known. The conveyor 2 and the labeling machine 3 (not shown but the intersection of its axis Z is marked in the figure) are operated in such a manner that the corner of the label 30 carried by the labeling head 3 coincides with the reference point 41 on the article 6. Then to give the label 30 the required orientation, the labeling head 3 is turned through 90°.

It can then be seen that the label 30 now occupies a position 42 that is offset by a distance d1 in the forward advance direction X of the conveyor 2 and by a distance d2 in the travel direction Y of the labeling head 3. It is then necessary to operate the conveyor 2 and the labeling head 3 so as to move the label from position 42 to position 40.

The offsets d1 and d2 are shown for turning through 90°, but similar offsets exist likewise for turning through any angle. The particular values of the offset depend on the pivot angle, which makes controlling the labeling machine complicated.

FIG. 3*b* shows a labeling machine of the invention in which the corner of the label 30 coincides with the pivot axis Z of the labeling head 3. If the axis Z of the labeling head is in alignment with the reference point 41 on the article 6, then turning the labeling head does not cause the corner of the label to move, so the corner continues to coincide with the reference point 41 on the article 6 regardless of the angle through which the labeling head 3 is pivoted.

In the example shown, turning the labeling head through 90° places the label 30 as held by the gripper means 14 so as to overlie the expected position 40 for the label on the article 6. This makes controlling the labeling machine much simpler.

Returning to FIG. 2, it can be seen that the support strip 8 and the label 30 held by the gripper means 14 follow a plane trajectory through the printer 7 and downstream therefrom. The term "plane" is used herein to mean that the middle plane of the support strip 8 remains the same all along the trajectory, thus defining a plane in which the trajectory of a midpoint on the support strip 8 is marked.

In traditional printers, the support strip 8 comes from a feed roll whose midplane coincides with the plane of the trajectory followed by the support strip 8 through the printer 7. Given the presence of the bracket 24 and of the pivot 21 above the labeling head 3, that method would require the roll to be placed in line with the printer 7, i.e. to the left in FIG. 2. The roll 15 would then be offset considerably from the axis Z and would therefore make the labeling head bulky, giving it a moment of inertia poorly suited to turning the printing head.

In order to avoid that drawback, the support strip 8 is caused, in the invention, to follow a twisted path between the roll and the printer so as to place the roll in a position where it reduces the moment of inertia of the labeling head. The term "twisted" is used to mean that the midplane of the support strip 8 does not lie continuously in the same plane between the feed roll 15 and the printer 7.

Figure 4:
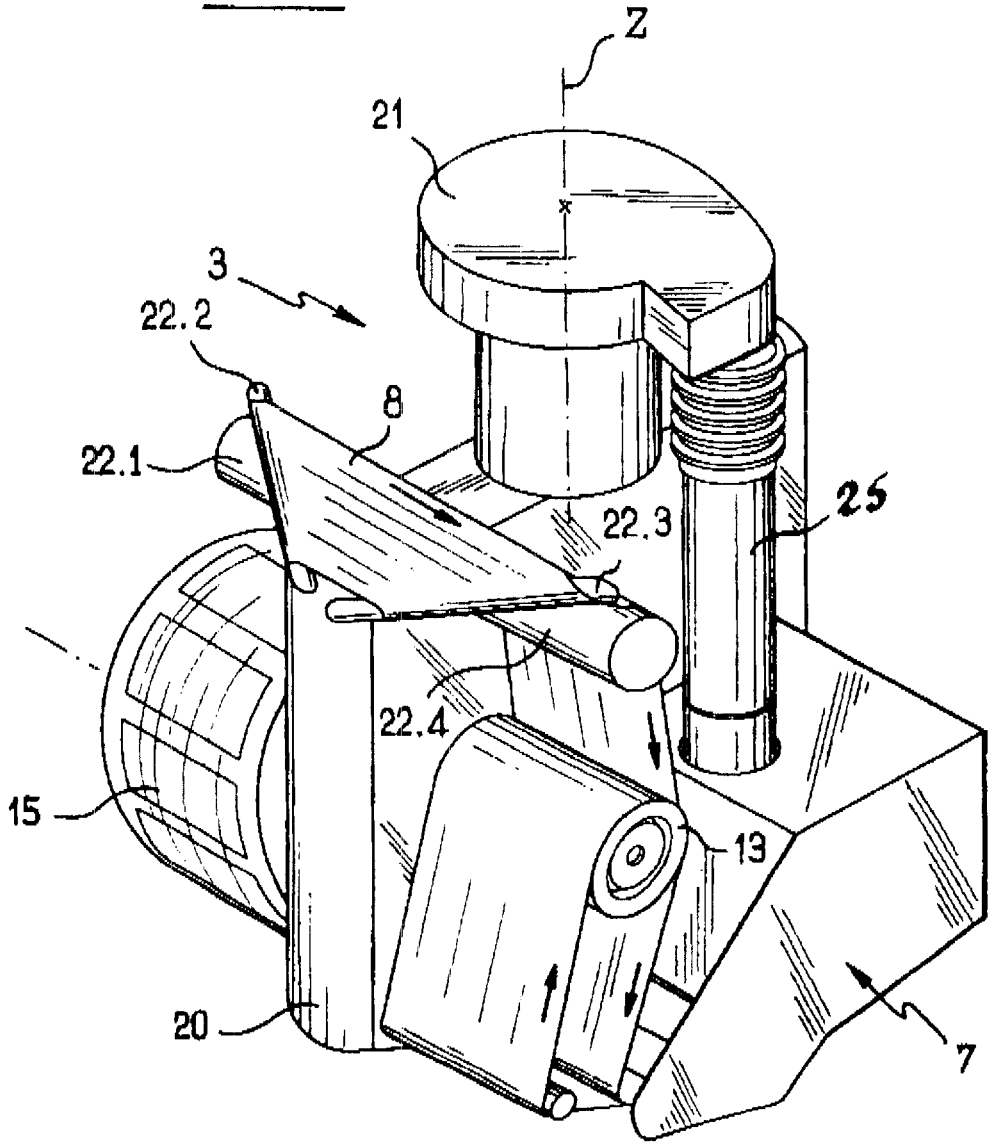
FIG. 4 is a fragmentary perspective view of a labeling head fitted to a labeling machine of the invention.
Figure 5:
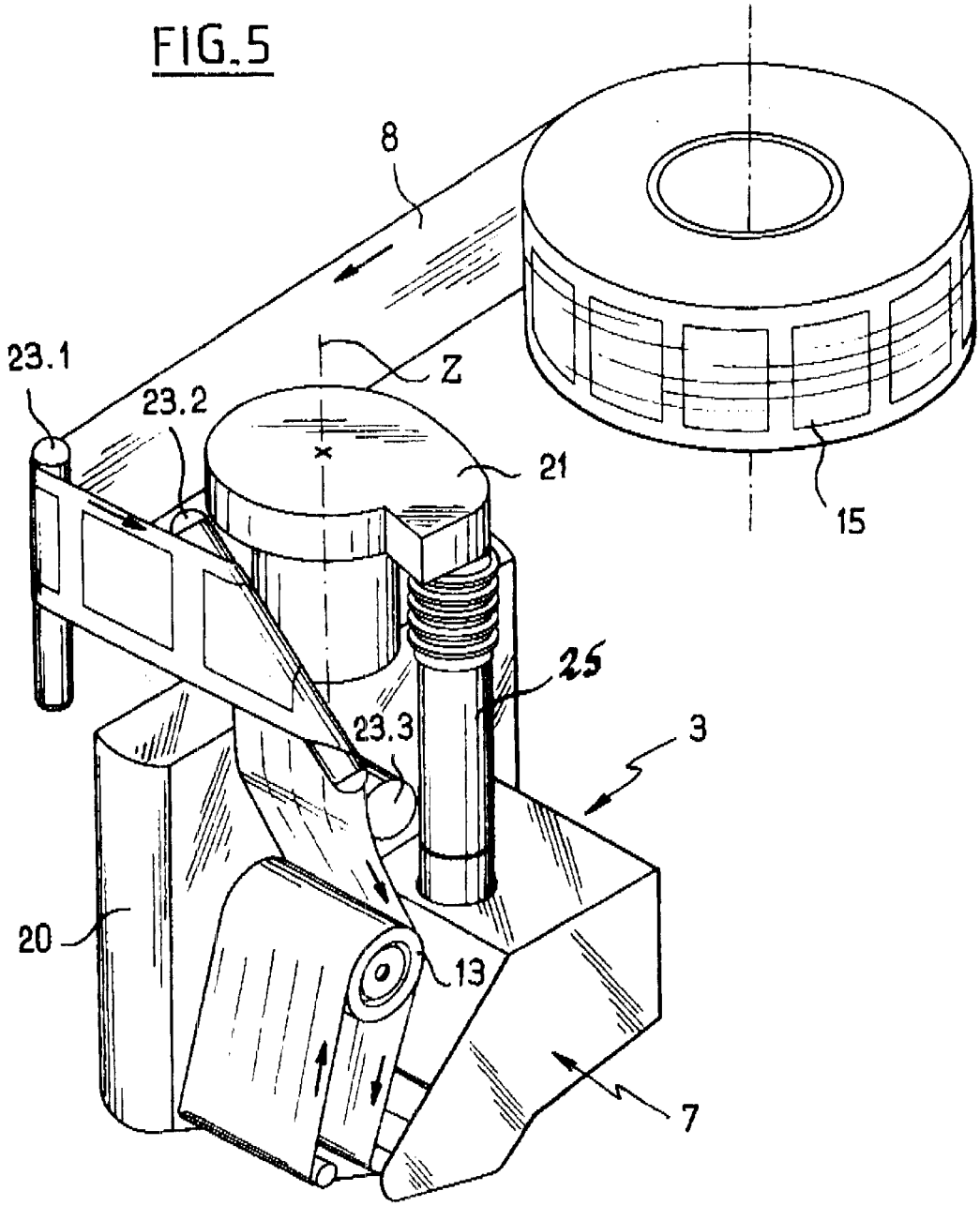
FIG. 5 is a fragmentary perspective view of a labeling head fitted to a labeling machine of the invention.

FIGS. 4 and 5 show two possible locations for the roll 15 in order to obtain this reduced moment of inertia. In these figures, only the labeling head 3 and the feed roll 15 are shown.

In FIG. 4, the feed roll 15 is installed on board the labeling head 3, but it is located beside the printer 7 on the opposite side of the support 20 from the printer 7 so that the midplane of the roll 15 and the midplane of the support strip 8 in the printer 7 are parallel and do not coincide. The support strip 8 is deflected towards the printer 7 by means of successive deflector cylinders 22.1, 22.2, 22.3, and 22.4, with the first and last deflector cylinders 22.1 and 22.4 being placed on a common axis parallel to the axis of the roll 15 and to the axis of the capstan 9 in the printer 7 (not visible in this figure). The arrows show the direction in which the support strip 8 advances.

In FIG. 5, the roll 15 is placed on the structure 1 of the labeling machine so that its axis of rotation is parallel to the pivot axis Z of the labeling head.

The support strip 8 passes firstly over a deflector cylinder 23.1 parallel to the pivot axis Z of the labeling head 3 and carried thereby. Thereafter, the support strip 8 is directed towards the printer 7 by means of a deflector cylinder 23.2 that is inclined at 45°, after which it is guided by a deflector cylinder 23.3 parallel to the axis of rotation of the capstan 9 (not visible in this figure). The first deflector cylinder 23.1 enables the labeling head 3 to pivot while ensuring that the path followed by the support strip 8 is compatible with such pivoting. The roll 15 can be fitted with tensioning means so as to ensure that the strip 8 takes up any excess length in the event of the labeling head 3 being moved in the direction Y towards the roll 15.

The invention is not limited to the particular embodiment described above, but on the contrary it extends to any variant coming within the ambit of the invention as defined by the claims.

For example, the pusher 17 could be actuated electromagnetically. The bracket 24 could be in the form of an arm comprising two hinged-together levers supporting the pivot 21 at its free end.

What is claimed is:

1. A labeling machine comprising a structure, a labeling head capable of pivoting relative to the structure about a pivot axis, the labeling head being fitted with gripper means for gripping a label holding it in a plane that is substantially normal to the pivot axis of the labeling head, and placing means carried by the labeling head and adapted to take the label held by the gripper means and place it on an article to be labeled that is present on the labeling machine, wherein the gripper means hold a label in such a manner that a corner thereof coincides substantially with the point of intersection of the pivot axis and the plane of the label.

2. A labeling machine according to claim 1, wherein the labeling head carries a printer having active print means and means for driving the label through the printer, and wherein the gripper means is situated immediately downstream from the active print means.

3. A labeling machine according to claim 2, wherein the active print means are controlled by control means not secured to the labeling head.

4. A labeling machine according to claim 2, wherein the active print means are adapted to receive a strip supporting adhesive labels coming from a roll, the labeling head having deflector members to impart a twisted trajectory to the support strip between the roll and the active print means.

5. A labeling machine according to claim 4, wherein the roll is rotatably mounted on the labeling head being located beside the active print means.

6. A labeling machine according to claim 4, wherein the roll is mounted to rotate on the structure of the labeling machine, the deflector members comprising a deflector secured to the labeling head and extending parallel to the axis whereby the labeling head pivots relative to the structure.

7. A labeling machine according to claim 4, wherein separator means for separating the support strip and a label is disposed between the active print means and the gripper means, the separator means being associated with means for rewinding the support strip.

8. A labeling machine according to claim 1, wherein the gripper means comprise a suction member holding the label via a non-adhesive face thereof.

9. A labeling machine according to claim 1, wherein the placing means comprise a pusher movable in a direction parallel to the pivot axis of the labeling head and pushing the label via its non-adhesive face towards the article to be labeled.

10. A labeling machine according to claim 1, wherein the structure includes a bracket forming a support for the labeling head, the labeling head being movable on the bracket in a direction perpendicular to its pivot axis and perpendicular to a forward travel direction of the article to be labeled.

* * * * *